US006976288B1

(12) United States Patent
Luca

(10) Patent No.: US 6,976,288 B1
(45) Date of Patent: Dec. 20, 2005

(54) ROD GRIPPER

(76) Inventor: Valentin Luca, 1157 Melville Ave., Fairfield, CT (US) 06825

( * ) Notice: Subject to any disclaimer, the term of this patent is extended or adjusted under 35 U.S.C. 154(b) by 8 days.

(21) Appl. No.: 10/356,842

(22) Filed: Feb. 3, 2003

(51) Int. Cl.[7] ..... E05F 3/00

(52) U.S. Cl. ..... 16/66; 16/2.1; 16/DIG. 17; 16/86 A; 403/374.5

(58) Field of Search ..... 16/66, 2.1–2.5, 16/273, 352, 353, DIG. 17, 86 C, 74, 86 R, 16/86 A, 86 B, 84, 51, 52; 292/305, 306, 292/DIG. 15, DIG. 19; 403/373, 374.1, 374.2, 403/374.5

(56) References Cited

U.S. PATENT DOCUMENTS 404,300 A * 5/1889 Perking ..... 474/97
2,930,070 A * 3/1960 Uebelhoer ..... 16/51
3,284,841 A * 11/1966 Patriquin ..... 16/52
3,591,669 A * 7/1971 Memory ..... 264/101
4,110,868 A * 9/1978 Imazaike ..... 16/84
4,483,044 A * 11/1984 Johnston et al. ..... 16/70
5,630,248 A 5/1997 Luca ..... 16/71
5,832,562 A 11/1998 Luca ..... 16/71
5,842,255 A 12/1998 Luca ..... 16/51
6,032,331 A * 3/2000 Alonso ..... 16/82
6,056,473 A * 5/2000 Schafer ..... 403/374.2

* cited by examiner

*Primary Examiner*—John B. Walsh
(74) *Attorney, Agent, or Firm*—Fattibene & Fattibene; Arthur T. Fattibene; Paul A. Fattibene

(57) ABSTRACT

A bar or rod gripper for arresting the linear axial movement of a rod, e.g. the piston rod of a door closure between a door open or closed position, that includes a compressible bushing slidably disposed about the rod or bar, and a canter washer disposed about the compression bushing whereby the canter washer, when tilted, will cause the compression bushing to compress to impose a surface to surface frictional force onto the bar or rod to resist or restrain the axial movement thereof without scoring, pitting or indenting the outer surface of the rod.

5 Claims, 6 Drawing Sheets

ROD GRIPPER

FIELD OF THE INVENTION

This invention is directed to a rod gripper for either arresting the axial movement of a rod or to effect a driving force on the rod, depending upon the application for the desired use thereof. A particular application for the described rod gripper is for arresting the piston rod of a piston actuated door closure, caulking gun or the like, or to incrementally advance or retract a rod or shaft in an axial direction of movement.

BACKGROUND OF THE INVENTION

Heretofore, canting grippers in the form of a canting washer for arresting the piston rod of a door closure has been well known, as taught in several of my prior U.S. Patents, viz. U.S. Pat. Nos. 5,630,248; 5,832,562 and 5,842,255. Similar canting washer type grippers have also been used to arrest or drive the piston of well known caulking guns. While such known canting washer type grippers are generally reliable and simple, it has been noted that they are not suitable for use for arresting or driving rods that are required to maintain a smooth or highly finished surface having a low coefficient of friction. As such known canting washers are generally formed of steel or hard metals, it has been noted that over time and repetitive use, the canting washer type grippers tend to score or impart micro indents upon the smooth surface of the rod which is unacceptable in certain applications. For example, in hydraulic actuated door closures or the like, where the rod functions as a piston rod, it is imperative that the surface of the piston rod be maintained smooth so as to prevent any loss of the actuating hydraulic fluid. Any pitting, scoring or micro denting the surface of such piston rod will eventually defeat any seal through which the piston rod moves relative to the door closure cylinder to cause resulting loss of the hydraulic actuating fluids.

SUMMARY OF THE INVENTION

An object of this invention is to provide an improved rod gripper construction for arresting or driving a rod in an axial direction in a manner that will prohibit any scoring, indenting or roughing of the smooth finish or surface of the rod.

Another object is to provide a rod gripper in the form of a resilient bushing which is rendered compressible under an applied gripper force to effect a surface to surface gripping action that prohibits any scoring or roughing of the smooth surface of the shaft.

Another object is to provide a rod gripper with improved reliability in effecting the arresting or driving of a rod moving in an axial direction.

The foregoing objects and other features and advantages are attained by an improved rod gripper, e.g. for use in a door closure, whether of a hydraulic or pneumatic type, which includes a resilient or compressible bushing having a longitudinal length arranged to circumscribe a portion of the shaft or piston rod extending beyond the cylinder in association with a canting mechanism wherein a canting force, applied to the canting mechanism, will cause the compressible bushing to transmit a surface to surface friction gripping force upon the surface of the rod to either arrest its axial movement or to drive the same, depending upon the nature of the application.

In one form of the invention, the compressible bushing is formed of a plurality of segmented parts arranged to circumscribe the rod which are maintained on the rod by the canting mechanism.

In another form of the invention, the respective segmented parts of the compressible bushing may be provided with longitudinal slots which are opened at one end so as to render the respective segments more readily compressible when the canting mechanism is actuated.

In another form of the invention, the compressible bushing is formed as a unitary component which includes a plurality of circumferential spaced slots which are opened to at least one end of the bushing.

In still another form of the invention, the compressible bushing comprises an integral bushing having a longitudinal length that includes a plurality of slots circumferentially spaced, wherein the alternating slots are opened to the respective opposed ends of the bushing. The slotted compressible bushing is disposed on a rod and actuated by the canting mechanism.

In still another form of the invention, the canting mechanism is provided with a canting hole wherein the periphery of the hole is circumscribed with a resilient grommet adapted to circumscribe the rod to effect the arresting or driving thereof, depending upon the desired application.

IN THE DRAWINGS

DETAILED DESCRIPTION

Figure 1:
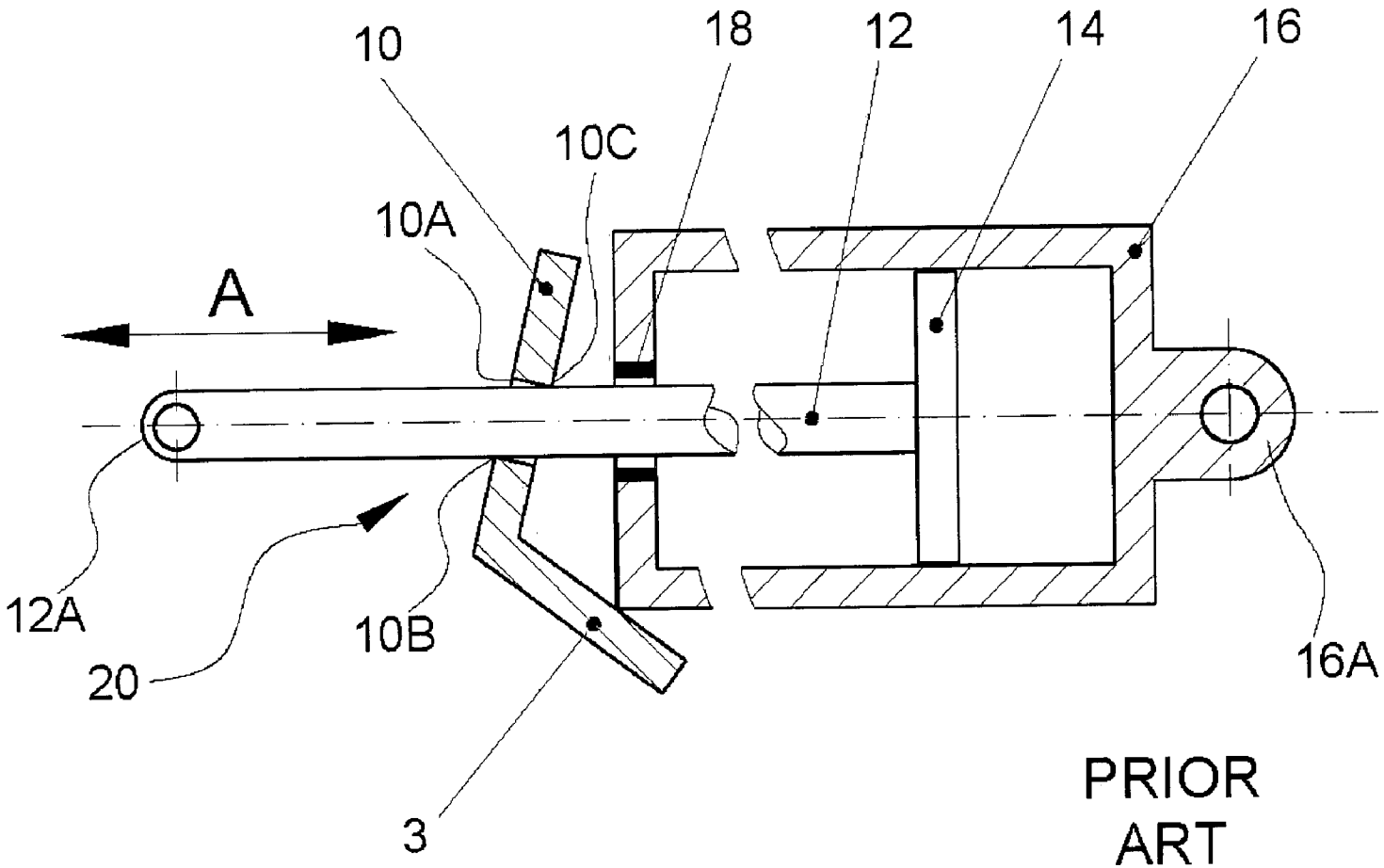
FIG. 1 is an illustrative sectional view of a typical prior art canting mechanism for use with a conventional piston actuated door closure.

Referring to the drawings, FIG. 1 illustrates a commonly known prior art rod gripper 10 as regularly used in association with a piston actuated door closure 20. Such door closure 20 generally includes a piston 14 connected to a reciprocating piston rod 12. The piston rod 12 extends through a seal packing 18 formed in one end of the cylinder 16 of the door closure 20. One end 12A of the piston rod is pivotally connected to a bracket secured to a door frame (not shown) and the other end 16A of the cylinder is suitably connected to a bracket secured to a door (not shown) in a conventional manner. As shown, the piston 14 and connected piston rod 12 is reciprocally mounted for movement in the axial direction as indicated by arrows A; as the door swings between open and closed position.

Slidably mounted on the extended end of the piston rod is a washer type gripper 10. The gripper 10 is provided with an opening 10A having a diameter slightly larger than the diameter of the rod 12 so that the gripper washer 10 is freely slidable along the rod 12. The arrangement is such that when the washer gripper 10 is cantered, the opposed edges 10B and 10C of the opening 10A will tend to "bite" onto the outer surface of the piston rod to restrain the door connected to the cylinder from closing. When the washer 10 is shifted to a vertical position relative to the axis of the rod 12, the door is freed to close. Depending upon the relative hardness of the metal washer type gripper 10 and the hardness of the metal piston rod 12, the gripping edges 10B and 10C of the gripper 10 will tend to score or indent the surface of the piston rod 12, which is undesirable, particularly when the piston 14 is hydraulically operated.

Figure 3:
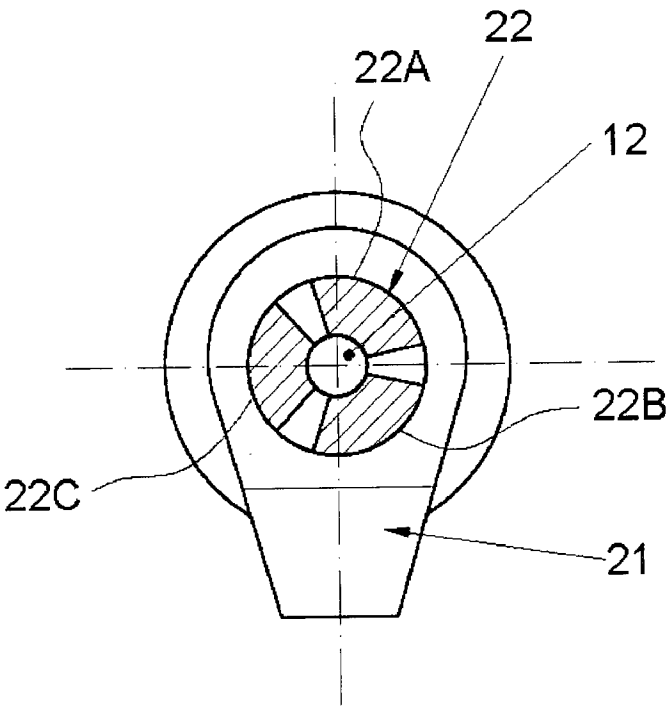
FIG. 3 is a sectional view taken along line 3—3 on FIG. 2.
Figure 2:
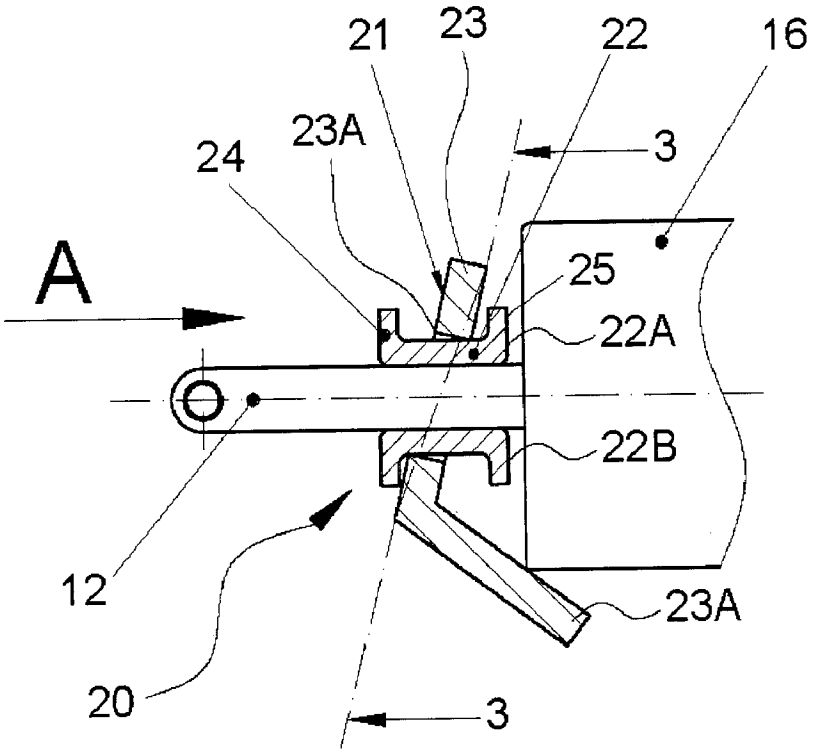
FIG. 2 is a sectional side view of a rod gripper embodying the invention as applied for arresting the piston rod of a piston actuated door closure.

To obviate the problem, FIGS. 2 and 3 illustrate one embodiment of an improved rod gripper 21. For purposes of description, the improved rod gripper 21 will be described for application with a door closure 20 which includes a cylinder 16 and an associated piston and connected piston rod 12 similar to that described with respect to FIG. 1. As shown in FIGS. 2 and 3, the rod gripper includes a bushing 22 and an associated cantering washer type member 23.

In accordance with this invention, the bushing 22 comprises a segmented bushing composed of two or more segments to form a cylindrical shaped member having a longitudinal length. In the illustrated embodiment, the bushing is formed of three similarly constructed segments 22A, 22B and 22C, as best seen in FIG. 3. As best seen in FIG. 3, the respective bushing segments 22A, 22B and 22C are circumferentially arranged about the outer periphery of the piston rod 12, wherein the adjacent longitudinal edges of the respective segments 22A, 22B and 22C are slightly spaced from one another. The opposed ends of the respective bushing segments extend radially outwardly to define radially outwardly extending opposed flanges 24 and 25, as best seen in FIG. 2. As best seen in FIG. 2, the inner periphery of the respective segments 22A, 22B and 22C define a surface to surface contact with the rod 12 when an applied force is imparted to the respective bushing segments 22A, 22B and 22C.

The respective bushing segments 22A, 22B and 22C are loosely retained about the rod 12 by a cantering washer 23. The cantering washer 23 is provided with an opening 23A having a diameter which is slightly greater than the outer periphery of the respective segments disposed between the opposed flanges 24 and 25. The arrangement is such that when the cantering washer 23 is in a vertical or neutral position relative to the longitudinal axis of the piston rod 12, the bushing 22 is loosely positioned relative to the rod 12. When the washer 23 is cantered, as seen in FIG. 2, the respective bushing segments will tend to compress tightly around the rod in a surface to surface contact and will frictionally restrain the movement of the piston rod 12 relative to the cylinder 16. Thus, the door can be restrained from closing or opening whenever the cantering washer 21 is cantered. Shifting the washer 21 to its neutral position will release the compression forces acting on the bushing segments 22A, 22B and 22C and thereby effecting the release of the piston rod 12. Because of the surface to surface contact between the bushing inner surfaces with the outer surface of the rod, any pitting, indentation or scoring of the piston shaft is avoided.

As seen in the drawing, the washer 23 may be provided with a bent tail portion 23A whereby the canter washer 23 may be maintained in a force applying position when the tail portion 23A is moved into engagement with the end of the cylinder 16.

Figure 4:
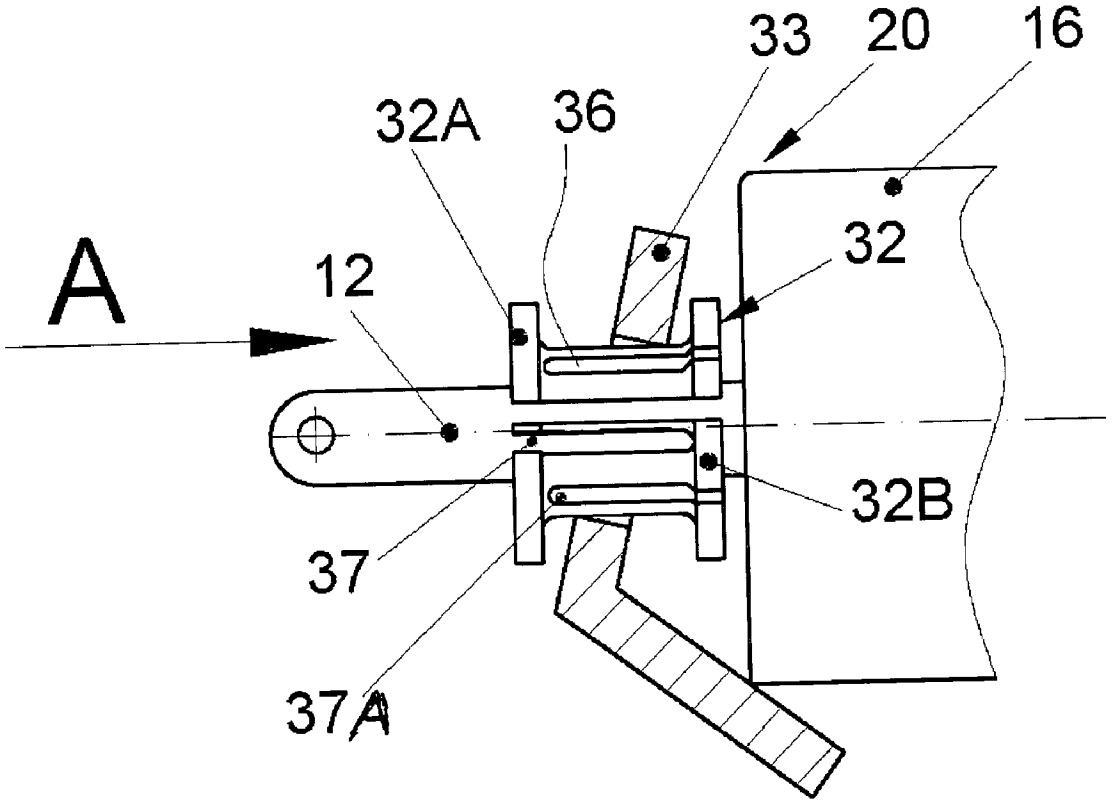
FIG. 4 is a side view of a modified form of the invention as applied to a piston actuated door closure.

FIG. 4 illustrates a modified embodiment of the invention. In this embodiment, the door closure 20 includes a piston and cylinder assembly 12 and 16 similar to that hereinbefore described. In this embodiment, the griper bushing 32 includes a plurality of component, e.g. segments 32A, 32B and 32C (not shown) similar to that hereinbefore described, with the exception that each segment is provided with one or more elongated slots 36 and 37 which may open to one or both ends thereof. For example, segment 32A may have slots 36 which are open to the right end as viewed in FIG. 4. Segment 32B is shown with slots 37 opening to the left end as viewed in FIG. 4, alternating with slots 37A which open to the right end. The third segment is not seen in FIG. 4. However, it will be understood that the unseen segment would also have one or more longitudinally extending slots as described. FIG. 4 is illustrative only to evidence the different forms the bushing segment may take. In practice, the segments comprising the bushing will be similar.

In all other respects, the arrangement of FIG. 4 is similar to that described with respect to FIGS. 2 and 3. In FIG. 4, the use of slots in the respective bushing segments 32A, 32B render the assembled bushing quite resilient. Thus, when the cantering washer 33, which is similar to that of FIGS. 2 and 3, is cantered, the respective bushing segments 32A, 32B and 32C (not seen) will compress to exert a restraining force on the piston rod 12.

Figure 6:
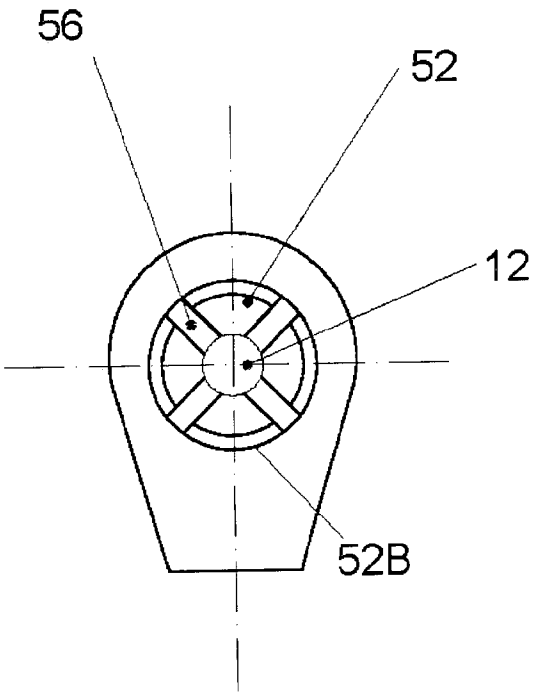
FIG. 6 is a sectional view taken along line 6—6 on FIG. 5.
Figure 5:
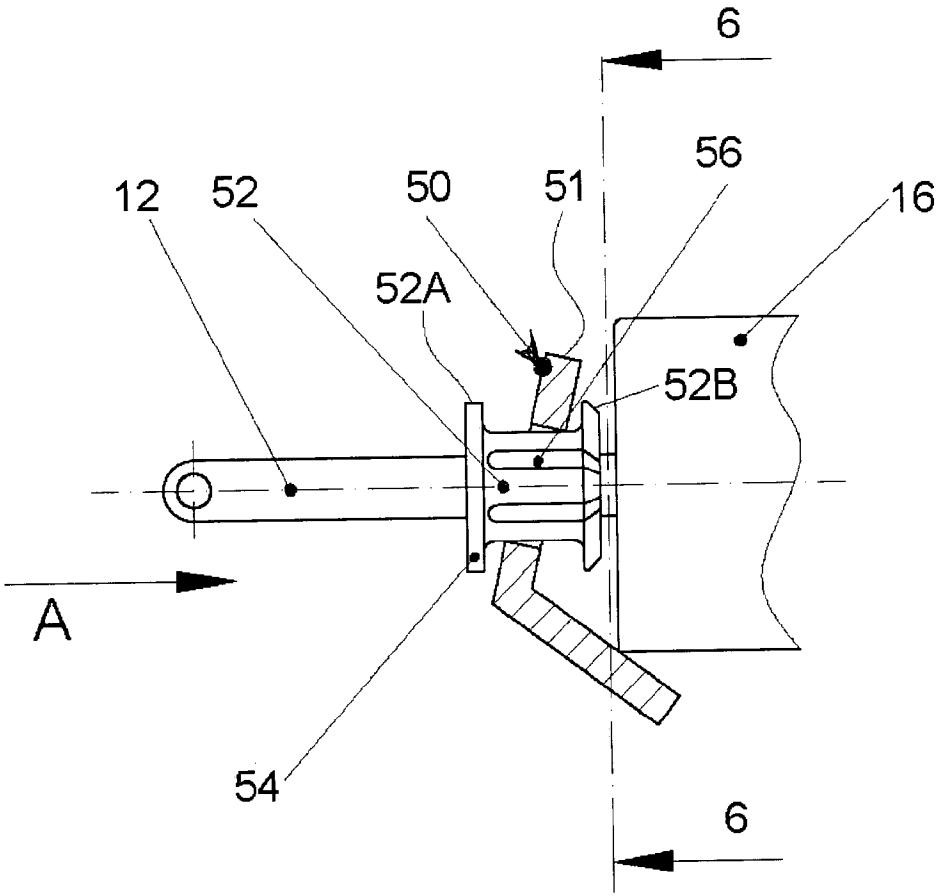
FIG. 5 is a side view of another modified form of the invention.

FIGS. 5 and 6 are described with respect to another modified embodiment. This embodiment is similar to that described with respect to those of FIGS. 2 to 4 with the exception that the restraining or driving means 50 is a modified version. In the illustrated embodiment, the restraining or driving means is utilized in conjunction with a door closure including a cylinder 16 and piston rod assembly similar to that hereinbefore described. In this form of the invention, the bushing 52 is formed as an integral member consisting of a unitary sleeve or cylindrical member which is arranged to be slidably supported on the extended end of a rod, e.g. a piston rod 12. The opposed ends of the bushing 52 are provided with outwardly and radially extending flanges 52A and 52B. Circumferentially spaced about the circumference of the integral bushing 52 are a plurality of longitudinal slots 56. The slots 56 open to one end of the bushing 52 only and provides the resiliency to the bushing 52.

The canting washer 51 of the restraining means 50 is disposed on the bushing 52 which is in sliding relationship relative to the extended end of the piston rod 12. In operation, a compression force is applied onto the resilient bushing 52 to place the bushing 52 in a restraining mode whenever the washer 51 is cantered a seen in FIG. 5. Returning the washer 51 to its neutral or vertical position will release the frictional force which the bushing 52 imparts to the rod 12.

In all other respects, the structure and function of the embodiment of FIG. 5 is similar to that described with respect to the embodiments of FIGS. 2 to 4.

Figure 7:
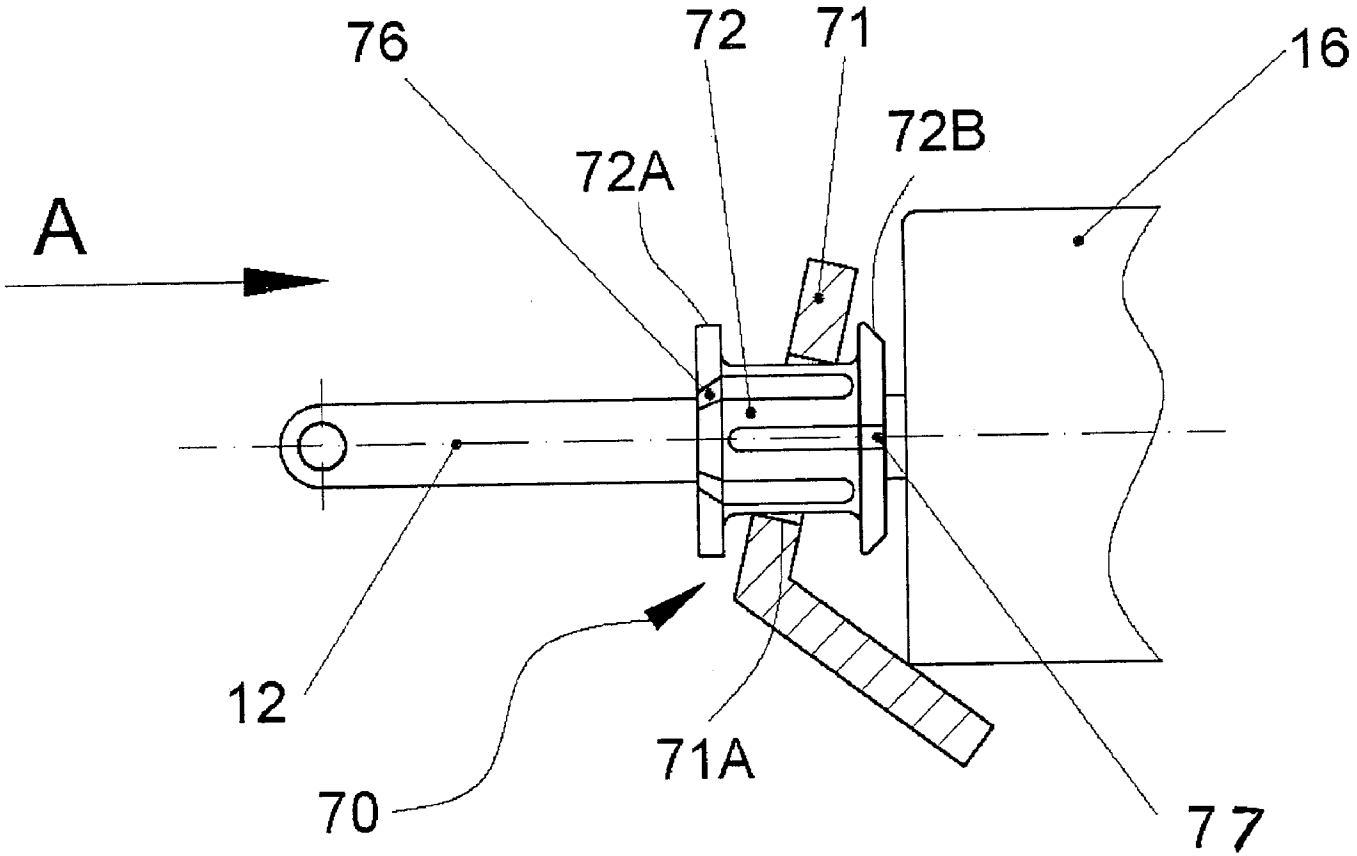
FIG. 7 is a partial sectional view of another embodiment of the invention.

FIG. 7 illustrates another embodiment of the invention. In this embodiment, the door closure comprised of a cylinder 16 and piston assembly 12 is similar to that hereinbefore described. However, the gripper means 70 is modified. As modified, the gripper bushing 72 comprises an integral annular member which is slidably mounted on the extended end of the piston rod 12. As shown, the opposed ends are provided with spaced apart, radially outwardly extending flange ends 72A, 72B.

The canter washer 71 is provided with an opening 71A which receives the intermediate portion of the bushing 72. In this form of the invention, the bushing 72 is provided with a series of alternating slots 76 and 77 circumferentially spaced about the periphery of the bushing. Slot 76 opens to the left end of the bushing as seen in FIG. 7 and slot 77 opens to the right side of the bushing as seen in FIG. 7. The bushing 72 so formed has a resiliency which, when a force is applied thereto, will cause the bushing to apply a compressive restraining force onto the piston rod to restrain any relative motion between the piston rod 12 and the bushing 72. The restraining force is applied to the bushing 72 whenever the canter washer is cantered, as seen in FIG. 7.

The formation of the alternating slots 76 and 77 define therebetween a series of flexible fingers which will flex when the washer 71 is cantered, whereby the fingers of the bushing will exert a friction force onto the piston rod to restrain the movement thereof. When the canting washer 71 is moved or tilted to a neutral or normal position relative to the longitudinal axis of the piston rod 12, the friction holding force is relieved, permitting the piston rod to move toward the open or closed position.

Figure 8:
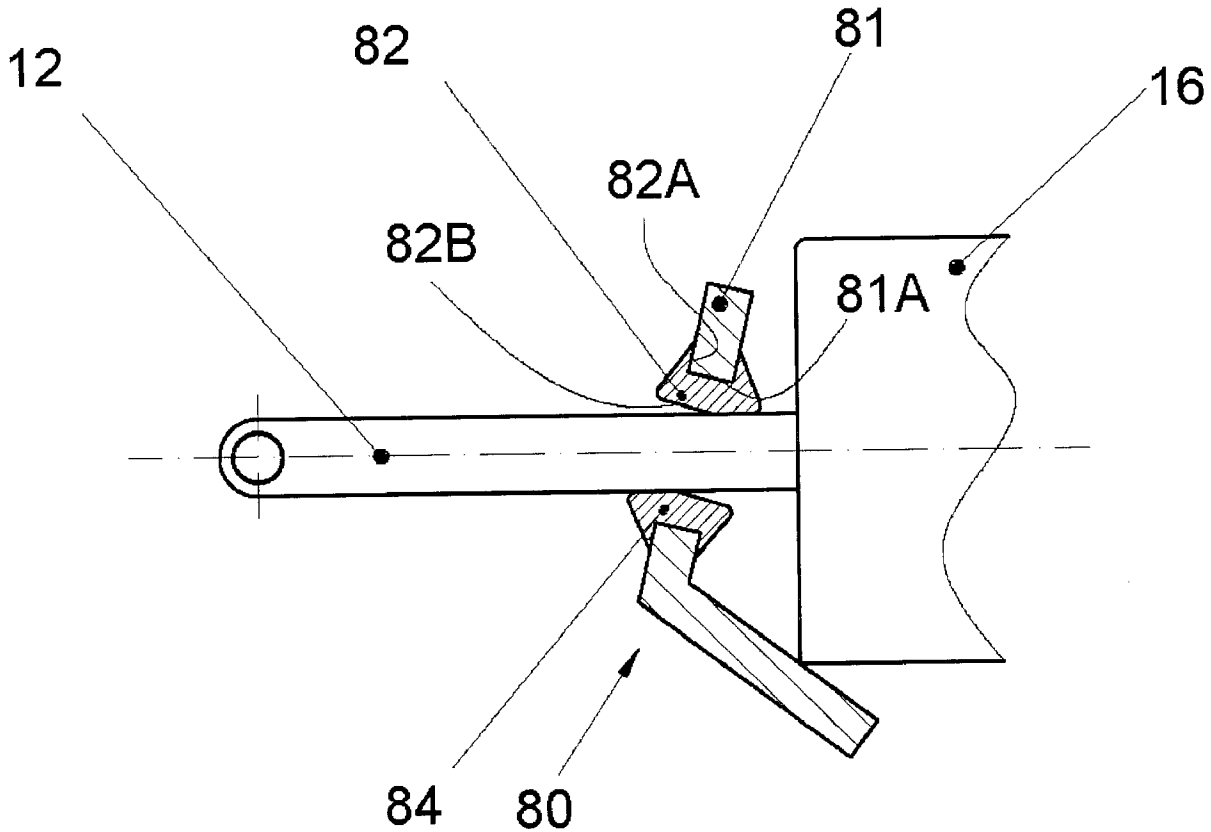
FIG. 8 is a partial sectional view of still another embodiment of the invention.

FIG. 8 illustrates a further embodiment of the present invention. The gripper means 80 is shown as applied to a door closure of the cylinder 16 and piston 12 type as hereinbefore described. In this form of the invention, the gripper means 80 includes a canter washer 81 which is provided with an enlarged opening 81A. Secured to the enlarged opening 81A is a gripping grommet 82. The grommet is preferably formed of a resilient material, e.g. a rubber, resilient plastic or synthetic rubber material. The grommet is provided with an annular outer groove 82A for mating and securing the grommet about the opening 81 of the canter washer. As shown, the inner periphery is arranged to engage the surface of the rod 12.

When the washer 82 is canted, as shown in FIG. 8, the diagonally opposed surfaces of the grommet engages the rod with a frictional bias that will resist any linear movement of the rod 12. When the washer 81 is tilted to a neutral or normal position relative to the longitudinal axis of the rod 12, the frictional holding forces are relieved, permitting the rod 12 to move toward the open or closed door position accordingly.

From the foregoing, it will be apparent that the described gripper embodiments will function to restrain or permit a rod or bar associated therewith to move in an axial direction in a simple and expedient manner without causing the gripping force imparted by the canter washer to score, indent and/or otherwise pit the surface of the rod or bar 12. Throughout the operating life of the respective described gripper means, the bar or rod associated therewith will maintain its outer surface smoothness. Further, the arrangement is such that when the canter washer is tilted, the associate bushing will be caused to compress and by so doing will impart a frictional holding force onto the associated rod or bar.

While the present invention has been described with respect to several embodiments, modifications and variations thereof may be made without departing from the spirit or scope of this invention.

What is claimed is:

1. A rod gripper assembly comprising:

an elongated rod, a compression bushing adapted to be slidably disposed for relative axial displacement along said rod, said compression bushing having a longitudinal length, a canter washer having an opening therein, said opening being sized to receive said bushing, whereby said canter washer when shifted to a tilted position imparts a compressive force onto said bushing which is transmitted to the associated rod to restrain any movement of said rod relative to said bushing without scoring, indenting or pitting the outer surface of said rod wherein said bushing includes:

a plurality of segments circumferentially spaced about said rod, each of said segments including a longitudinal length and a radially outwardly extending flange defining the opposed ends of said segment forming an intermediate portion therebetween, said intermediate portion of said segments forming an annular groove between said flanges.

2. A rod gripper assembly as defined in claim 1 wherein each of said segments have opposed longitudinal edges, said longitudinal edges of one segment being circumferentially spaced from the longitudinal edges of the next adjacent segment in the assembled position thereof.

3. A rod gripper assembly as defined in claim 2 wherein each of said segments includes a longitudinal slot formed therein, said slot being open at one end of said segment, and wherein said slot is closed at the other end of said slot.

4. A door closure comprising:

a cylinder having a piston reciprocally mounted therein, a piston rod connected to said piston and said piston rod having a portion extending outwardly of the cylinder, a gripper means mounted on the extended portion of said piston rod, said gripper means including a compression bushing slidably disposed on the extended portion of said piston rod, and means for exerting a compressive force onto said compression bushing whereby said compressive force imparted on said bushing is transmitted to said piston rod to frictionally restrain any axial movement of said piston rod relative to said bushing wherein said bushing includes:

a plurality of longitudinal segments circumferentially spaced about said piston rod, each of said segments including a radially outwardly extending flange defining the opposed ends of each of said segment and an intermediate portion therebetween, said intermediate portion of said segments forming an annular groove between said flanges, and said compression means including a canting washer having an opening sized to receive said segments circumferentially spaced about said piston rod whereby said canting washer when tilted from its normal position transmits a compressive force on said segments to impart a frictional force on said piston rod to restrain axial movement of said piston rod relative to said bushing.

5. A door closure as defined in claim 4 wherein each of said segments includes an elongated slot which opens to one end of each of said segments.

* * * * *